US010570713B2

(12) United States Patent
Hyde, Jr.

(10) Patent No.: US 10,570,713 B2
(45) Date of Patent: Feb. 25, 2020

(54) MULTI-ZONE FRACTURING IN A RANDOM ORDER

(71) Applicant: Meduna Investments, LLC, Cypress, TX (US)

(72) Inventor: Albert E. Hyde, Jr., Houston, TX (US)

( * ) Notice: Subject to any disclaimer, the term of this patent is extended or adjusted under 35 U.S.C. 154(b) by 250 days.

(21) Appl. No.: 15/095,986

(22) Filed: Apr. 11, 2016

(65) Prior Publication Data

US 2016/0298422 A1 Oct. 13, 2016

Related U.S. Application Data

(60) Provisional application No. 62/145,965, filed on Apr. 10, 2015.

(51) Int. Cl.

| | |
|---|---|
| ***E21B 43/14*** | (2006.01) |
| ***E21B 34/14*** | (2006.01) |
| *E21B 34/00* | (2006.01) |

(52) U.S. Cl.

CPC ..... *E21B 43/14* (2013.01); *E21B 34/14* (2013.01); *E21B 2034/007* (2013.01)

(58) Field of Classification Search

CPC ..... E21B 43/14; E21B 34/14; E21B 2034/007
See application file for complete search history.

(56) References Cited

U.S. PATENT DOCUMENTS

| | | | | |
|---|---|---|---|---|
| 7,096,945 | B2 * | 8/2006 | Richards | E21B 34/06 166/236 |
| 2009/0084553 | A1 * | 4/2009 | Rytlewski | E21B 34/06 166/305.1 |
| 2015/0060076 | A1 * | 3/2015 | Campbell | E21B 34/14 166/308.1 |
| 2016/0258260 | A1 * | 9/2016 | Walton | E21B 34/06 |

* cited by examiner

*Primary Examiner* — Michael R Wills, III

(57) ABSTRACT

A multi-zone formation has a plurality of sliding sleeve valves for selective access to the formation from the wellbore. Each of the sliding sleeves has a unique latch profile such that an initial dart with a matching profile will land on the predetermined sleeve. With all the sliding sleeves initially in the position where access ports are closed the sleeve that gets the first dart has pressure applied to shift that sleeve to the ports open position for well treatment. Thereafter, a second dart lands on the first effectively closing the ports just opened. Further pressure closes the sliding sleeve and blows both darts to hole bottom. Any other sleeve can then be selected with a unique profile that matches another sliding sleeve and the process repeats. For production selected sliding sleeves are opened preferably with a wireline shifting tool.

18 Claims, 10 Drawing Sheets

MULTI-ZONE FRACTURING IN A RANDOM ORDER

RELATED PRIORITY DATE APPLICATION

This application claims the benefit under 35 U.S.C. 119(e) of the U.S. provisional application No. 62/145,965 filed on Apr. 10, 2015.

FIELD OF THE INVENTION

The field of the invention is fracturing multiple zones and more particularly methods of fracturing the zones in a random order with sleeve valves having unique profiles that can be selectively opened and then closed without well intervention.

BACKGROUND OF THE INVENTION

Fracturing operations can be in a bottom up orientation where progressively larger balls sequentially land on bigger seats to isolate zones already fractured so that the next zone uphole can be fractured. The procedure is repeated until all the zones are fractured. The balls can either be lifted to the surface with subsequent production from all zones or the balls can also be removed by blowing them through seats or drilling them out so that production can take place from the desired zones. Frequently wellbore intervention is needed to close sliding sleeve valves if production is needed only from select zones. Other techniques using sliding sleeve valves combines actuation to open with a ball landed on a seat and subsequent closure of the sliding sleeve with well intervention using a shifting tool. This method is illustrated in WO2014/094136. In US 2014/0345876 the same open and close technique using well intervention to close the fracturing port is illustrated.

Unique profiles are used in tandem with a hydraulic tool to operate a variety of tools in a single trip using unique flow signaling as described in US 2010/0089587. In other designs darts with unique latch profiles are deployed on a rod with multiple sensors to be released to latch with matching profiles on sleeves for well stimulation as described in US2012/0048570. In U.S. Pat. No. 8,757,265 a plurality of subterranean tools can be operated with balls that emit an RFID signal to operate the tools in a desired order when a unique signal operates a unique tool so that the associated actuator for the tool is signaled to operate in response to the unique RFID signal associated with the dropped ball.

What is needed and provided by the present invention is a way to fracture zones in any desired sequence without well intervention. The method is accomplished with sliding sleeve valves with unique profiles to accept darts with matching profiles. A selected valve gets a predetermined dart with a matching profile to allow subsequent pressure buildup to shift the sleeve to the ports open position. After the well treating job through the opened ports is completed a second dart lands on the first dart to effectively closed the open ports to allow a second pressure buildup on the sleeve to shift the sleeve so that the ports are then closed. Thereafter both darts are blown through the sleeve to hole bottom. At this point any other sleeve can be addressed by a conforming profile on another dart pumped into the borehole and the process repeats. After the treatment is over selected sleeves can be moved to a full open, screened open or choke position with wellbore intervention such as a shifting tool, pumping another dart, or in other ways. The method allows a random order of treatment of multiple zones without well intervention.

These and other advantages of the present invention will become apparent from the following description and drawings. Those skilled in the art will further appreciate other aspects of the invention from a review of the detailed description of the preferred embodiment and the associated drawings while understanding that the full scope of the invention can be determined by the appended claims.

SUMMARY OF THE INVENTION

A multi-zone formation has a plurality of sliding sleeve valves for selective access to the formation from the wellbore. Each of the sliding sleeves has a unique latch profile such that an initial dart with a matching profile will land on the predetermined sleeve. With all the sliding sleeves initially in the position where access ports are closed the sleeve that gets the first dart has pressure applied to shift that sleeve to the ports open position for well treatment. Thereafter, a second dart lands on the first effectively closing the ports just opened. Further pressure closes the sliding sleeve and blows both darts to hole bottom. Any other sleeve can then be selected with a unique profile that matches another sliding sleeve and the process repeats. For production selected sliding sleeves are opened preferably with a wireline shifting tool.

BRIEF DESCRIPTION OF THE DRAWINGS

For a detailed description of the preferred embodiment of the invention, reference will now be made to the accompanying drawings wherein.

DETAILED DESCRIPTION OF THE PREFERRED EMBODIMENT

Figure 1:
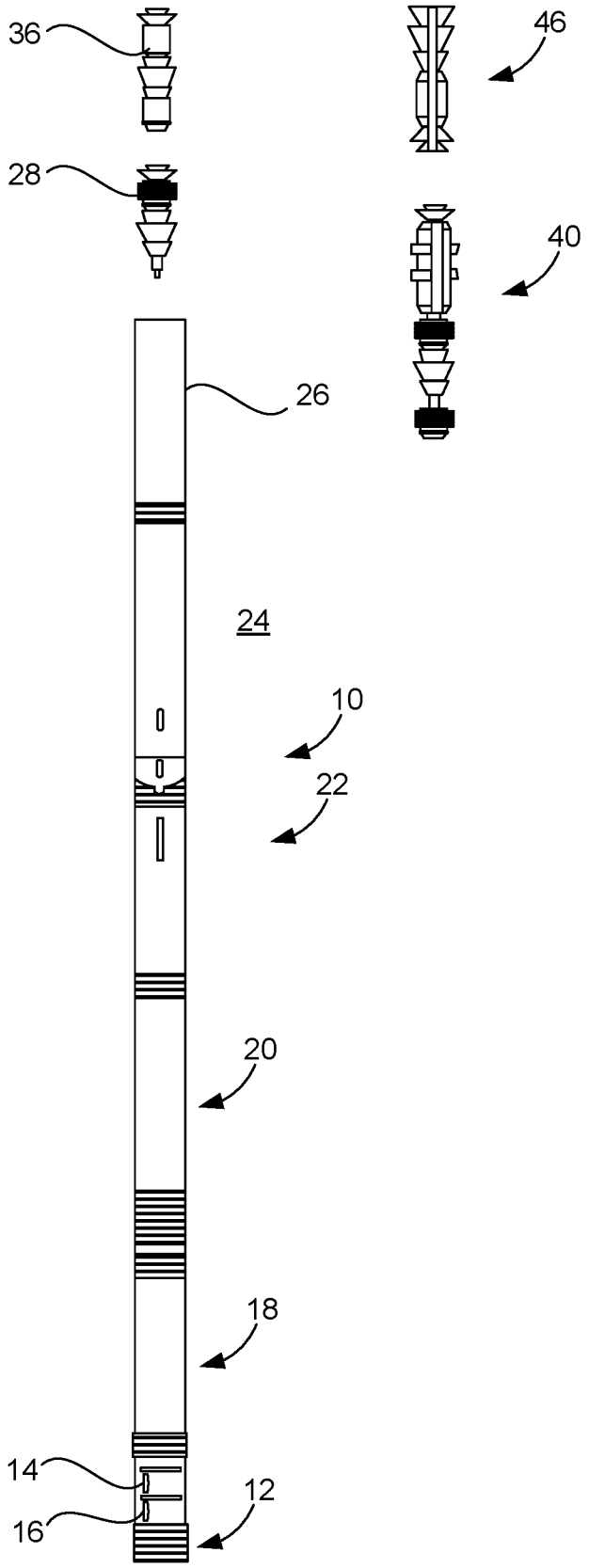
FIG. 1 shows the basic system components.
Figure 7:
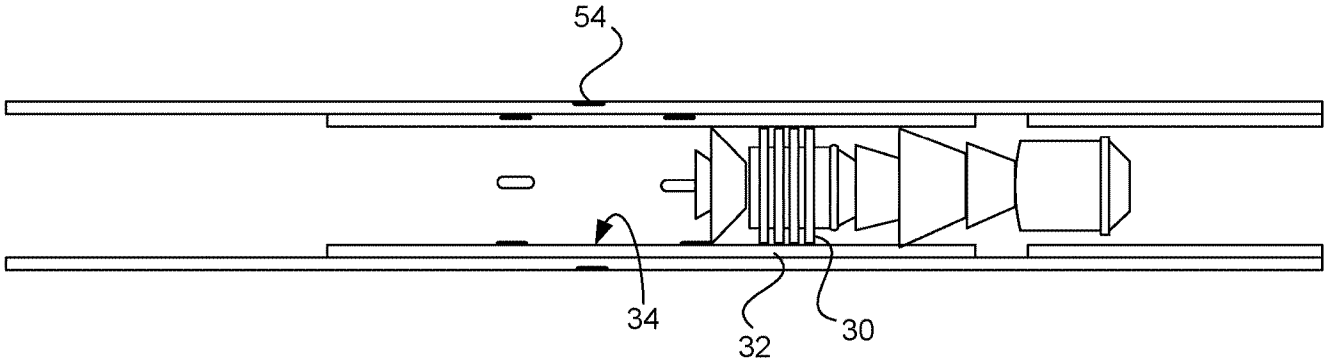
FIG. 7 is the view of FIG. 2 with the first dart landed in a matching profile.
Figure 12:
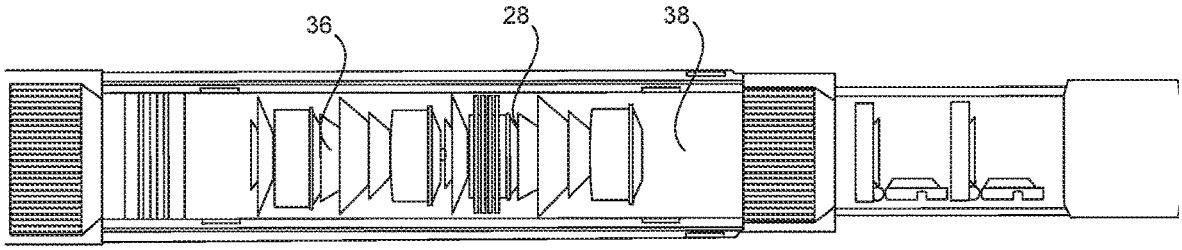
FIG. 12 is the view of DIG. 11 showing both darts traveling through the starter valve and captured in a catcher below.

The basic components of the subterranean treating system are shown in FIG. 1. The bottom hole assembly (BHA) 10 has a known cementing shoe 12 with a pair of flapper valves 14 and 16 to prevent pumped cement from u-tubing back out of the annulus and into the BHA 10. Above the shoe 12 is a starter valve 18 designed to selectively open the toe of the well for treatment and to open a flow path into the formation for pumped dart delivery as will be explained below. Above the starter valve 18 are alternating tubulars 20 and treatment valves 22 strategically placed in the completion for treating respective adjacent zones 24. Additional tubulars 26 extend the completion to another uphole string or to the surface depending on the well configuration. Treatment valves 22 are sequentially operated to open from an initially closed position by virtue of an opening pumpable dart 28. Each dart 28 has a unique profile 30 (see FIG. 7) that registers with a mating profile 32 unique to each sliding sleeve 34 that is part of each treatment valve 22. To close a given treatment valve 22 a second pumpable dart 36 lands on dart 28 and with applied pressure shifts the sleeve a second time in the same direction as the initial movement of sleeve 34 to the closed position, whereupon further pressure buildup releases both darts 28 and 36 to and through the starter valve 18 into a catcher volume 38 (see FIG. 12). Ultimately when all the treatment valves 22 have been opened, used for treatment and then reclosed in any desired order an isolation plug 40 is delivered so that its profile 42 registers with a starter valve profile 44 to seal the starter valve 18 closed (see FIG. 16). Optionally, production of the formation near the toe of the well or at the starter valve location can take place exclusively or with other zones that have had their sliding sleeve 34 moved to an open position as will be explained in more detail below. Finally, dart 46 has the ability to travel through the treatment valves and sequentially register with all the sliding sleeves 34 to push them closed and pass through to the starter valve 18 should there be a need to shut in the well.

Figure 2:
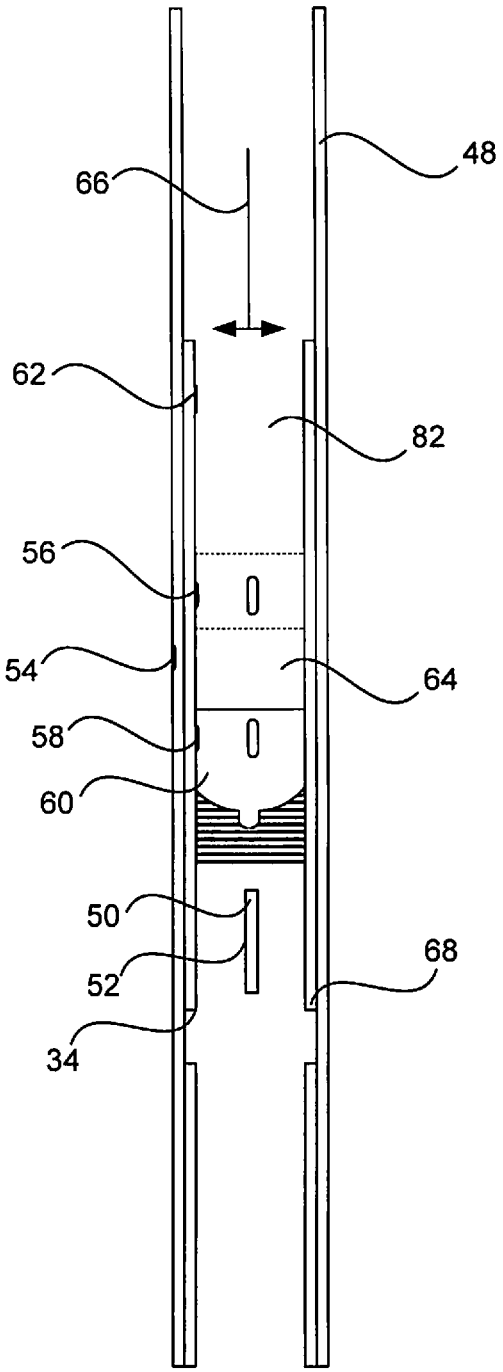
FIG. 2 is a detailed view of a treatment valve that is part of the system.

FIG. 2 shows a treatment valve 22 in more detail. A housing 48 is rotationally locked to the sleeve 34 by virtue of a pin 50 on the housing 48 extending into a longitudinal slot 52. Housing openings 54 are shown misaligned from openings 56 on the sliding sleeve 34. When those openings align the fully open position of the treatment valve 22 is achieved for operations such as fracturing or acidizing, for example. Openings 58 have screen 60 across them and represent a screened open position for the valve 22 when in production. Openings 62 are used for a choke position when aligned with openings 54 for flow balancing among several zones that could be in production at the same time. Openings 58 and 62 can both be above the closed portion 64 for the valve 22 such that the sequence of movement from initially closed to open and back to closed followed by reopening for production can occur with movement of the sleeve 34 in a single direction. Making the latter pattern possible allows making the movements without well intervention such as the use of dart 28 to open a specific valve 22 followed by dart 36 landing on the dart 28 to reclose the valve, followed by another dart (not shown) to reopen the valve 22 to a screened or choked or even a wide open position for later production. Alternatively, the first two movements in the same direction can open and then close the valve 22 while borehole intervention with a shifting tool on wireline or coiled tubing, or a tractor device on slickline, for example, shown schematically as 66 can be used to register with at least one specific valve 22 to put that valve in a desired position. Item 68 is a schematic representation of a detent device that bumps the sleeve 34 progressively into different positions. This can be a biased collet that finds grooves in succession, a snap ring that progressively finds different grooves, a stepper motor that drives sleeve 34 in increments or a spring loaded j-slot responsive to pressure cycles on landed darts 28 and 36 to name a few examples.

Figure 3:
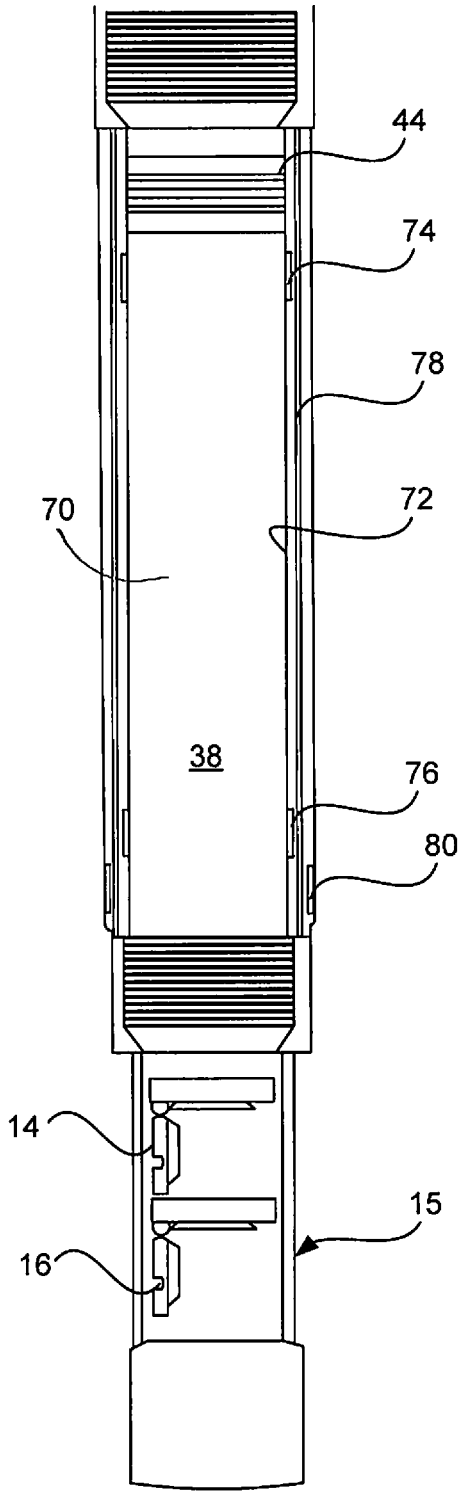
FIG. 3 is a detailed view of the starter valve that is part of the system.
Figure 4:
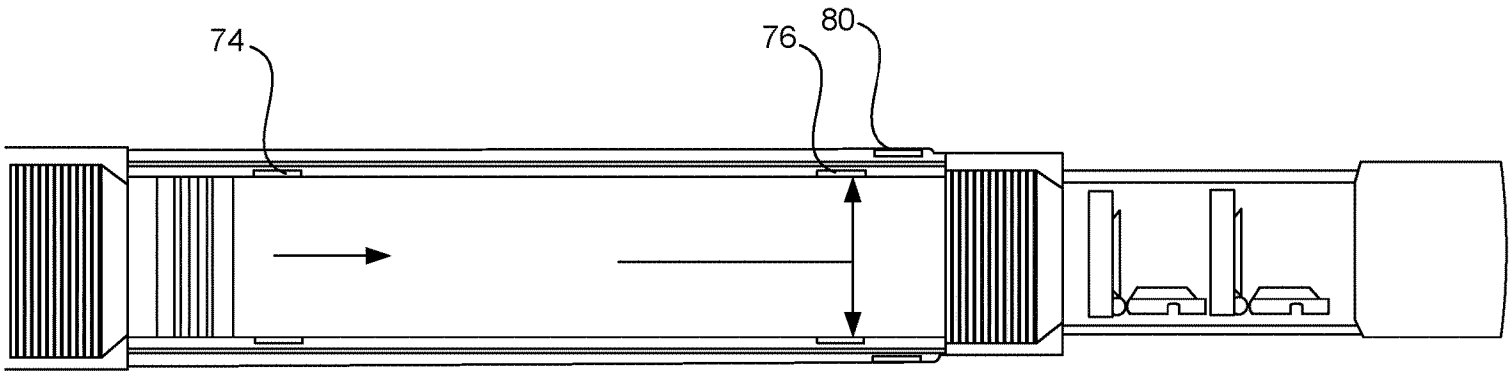
FIG. 4 is a view of the starter valve where the first burst disc is broken with pressure.
Figure 5:
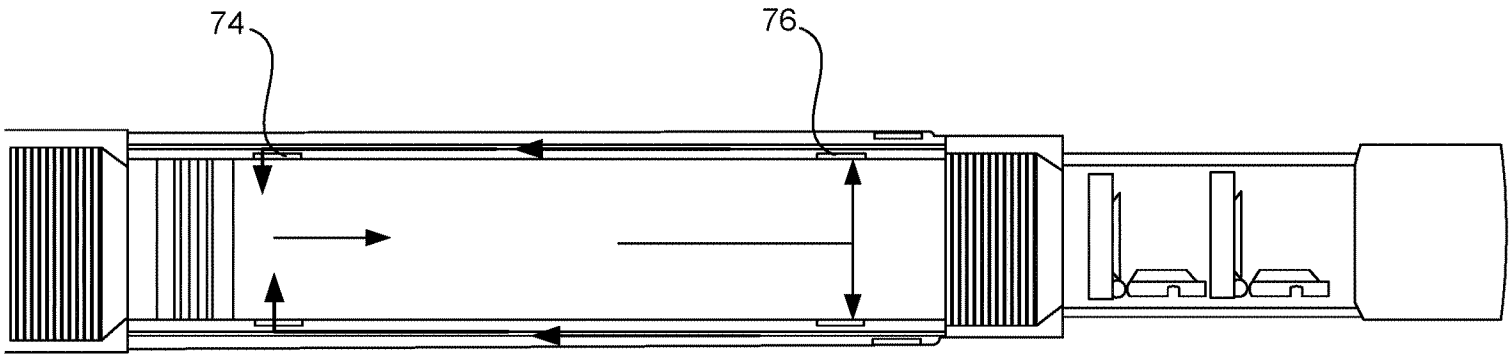
FIG. 5 is the view of FIG. 4 where the second rupture disc is broken.
Figure 6:
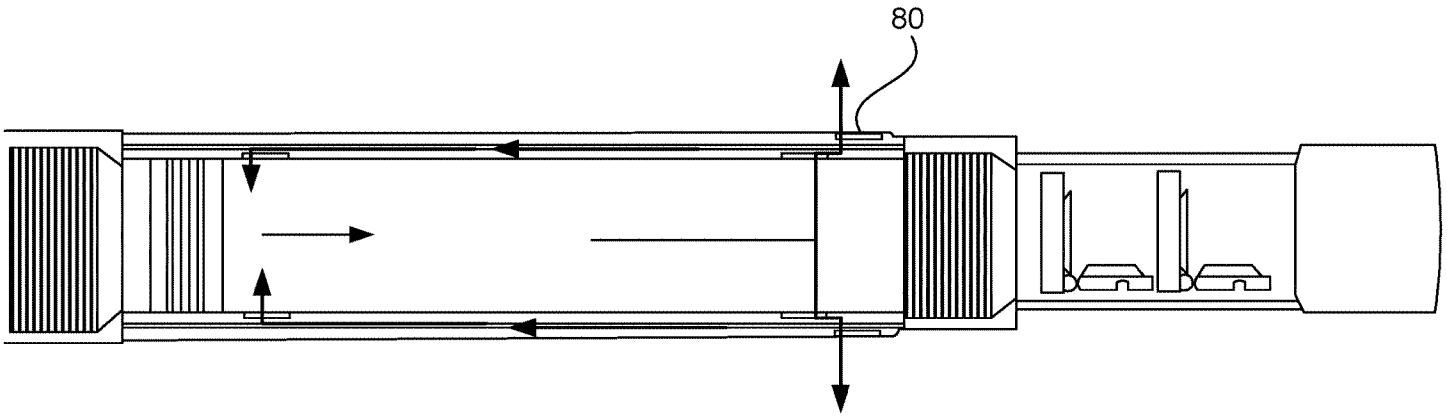
FIG. 6 is the view of FIG. 5 with the third rupture disc broken.
Figure 16:
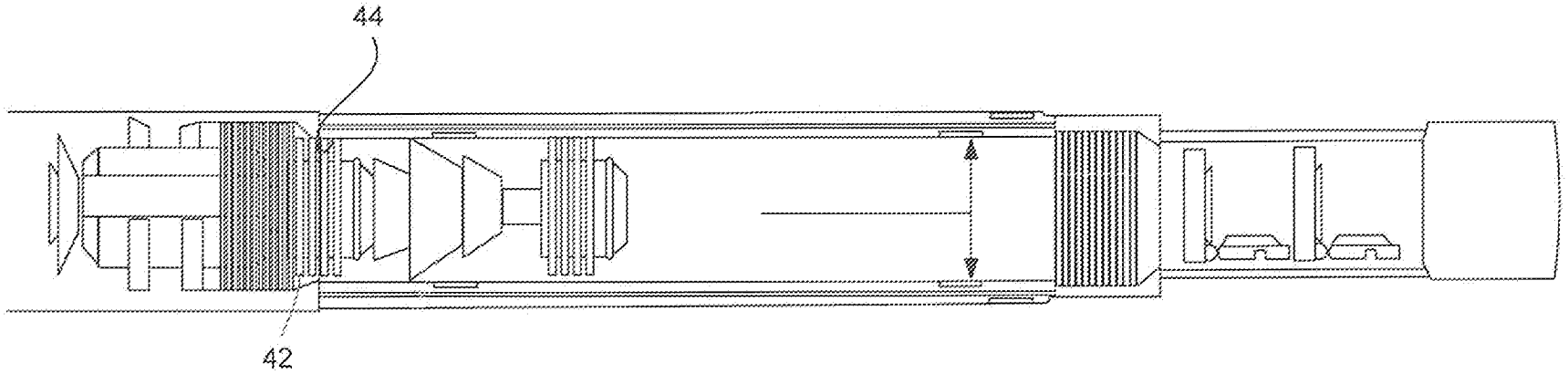
FIG. 16 shows the plug in the starter valve to close it.

Referring now to FIG. 3 the starter valve 18 is shown in more detail above the flappers 14 and 16 that are part of a cement shoe 15. The starter valve 18 has a profile 44 to match profile 42 in isolation plug 40 as shown in FIG. 16. Chamber 70 is for catching darts 28 and 36 after they get blown through a treatment valve 22 as described above. Inner wall 72 has upper rupture discs 74 and lower rupture discs 76 that lead to a fluid bypass channel 78 which in turn leads to rupture discs 80 for access to the annulus. The rupture discs break sequentially with applied pressure when all the treatment valves are closed as the assembly is first run before treatment begins. With the rupture disc broken the darts 28 and 36 can be delivered to each treatment valve 22 and then blown though into catch volume 38. FIGS. 4-6 represent schematically the order of breakage of the rupture discs as 76, 74 and 80. When the FIG. 6 position is achieved, the toe of the well can be treated first. Pumping subsequent darts 28 and 36 is made possible by the flow passages shown in FIG. 6 being open to allow fluid displacement to the formation ahead of such darts as the treatment progresses through the various treatment valves 22.

Figure 8:
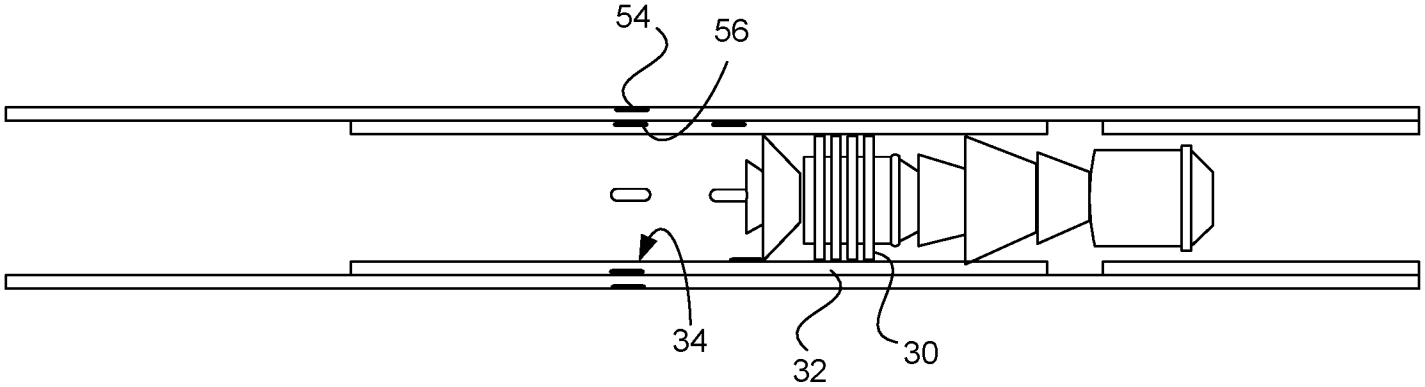
FIG. 8 is the view of FIG. 7 with the valve ready to shift to the open treating position.
Figure 9:
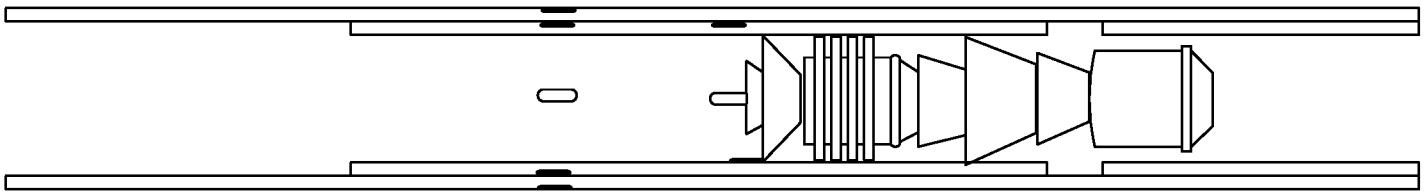
FIG. 9 is the view of FIG. 8 with the valve shifted to the treating position.
Figure 10:
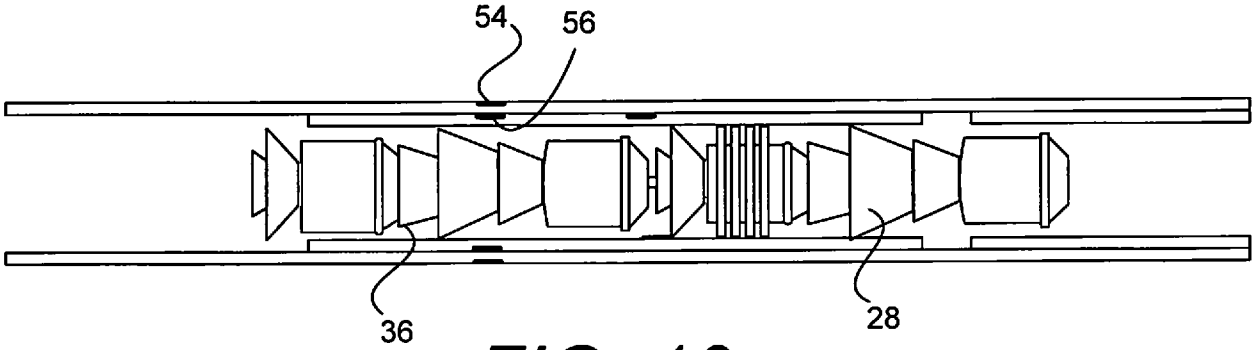
FIG. 10 is the view of FIG. 9 with a second dart landed and ready to further shift the valve in the same direction for closure so that another location can then be treated.
Figure 11:
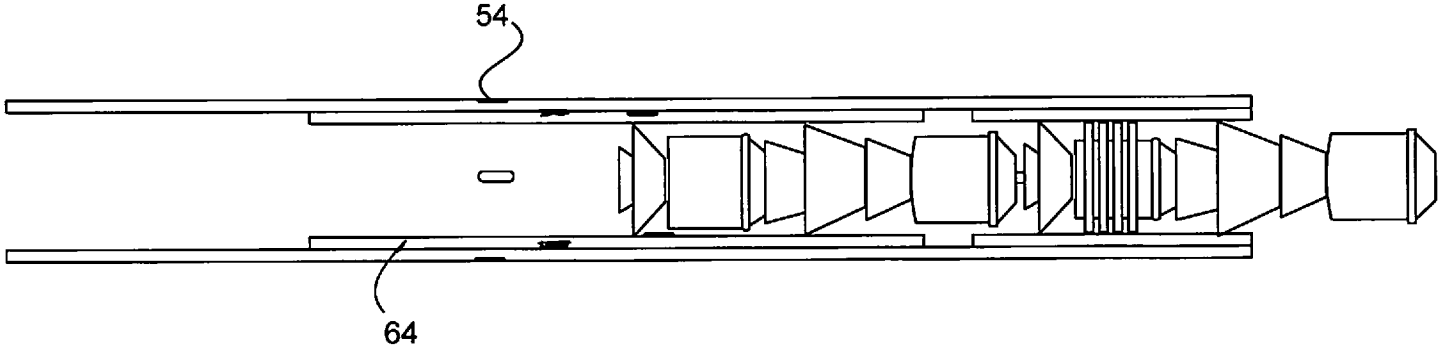
FIG. 11 is the view of FIG. 10 with the valve shifted closed and both darts released from the landing profile.

FIGS. 7-10 show the sequence of landing dart 28 with a unique profile 30 into a matching profile 32 in sliding sleeve 34. In FIG. 8 pressure is then applied from the surface or other location to slide sleeve 34 to open ports 54 for treatment when ports 56 are moved into alignment with ports 54. When the treatment concludes as shown in FIG. 8, dart 36 lands on dart 28 and further pressure is applied as shown in FIG. 10. This is made possible because dart 36 when landed on dart 28 covers ports 56, 54 so that the sleeve 34 can be moved a second time in the same direction as the initial movement that opened ports 54. Closed portion 64 lines up with ports 54 to close them as shown in FIG. 11. Continued pressure buildup blows both darts 36 and 28 into catch volume 38 in the starter valve 18. This happens because the profile 30 on the dart 28 has a shear release that allows the profile 30 to retract into an adjacent slot (not shown) on the dart 28 body so that dart 28 with dart 36 that has landed on it can both be blown through the sleeve 34 to which dart 28 had been previously engaged.

Figure 13:
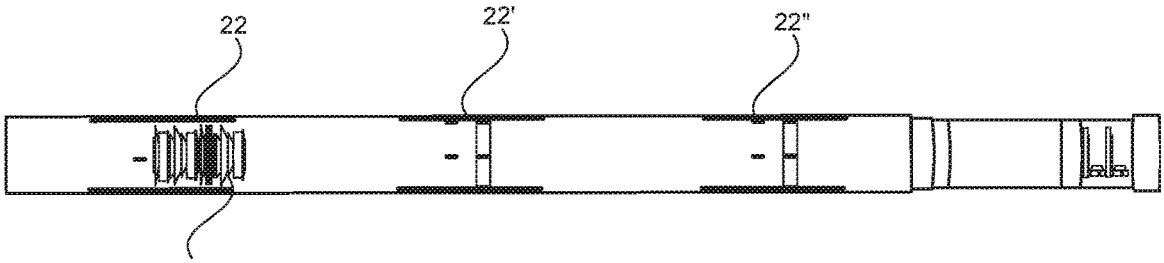
FIG. 13 is a view of a first zone furthest uphole being treated first.
Figure 14:
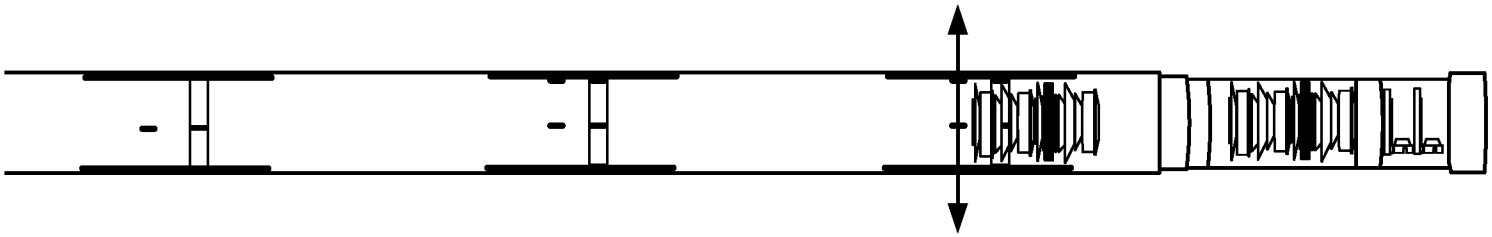
FIG. 14 is the view of FIG. 13 showing a lowermost zone being treated second.
Figure 15:
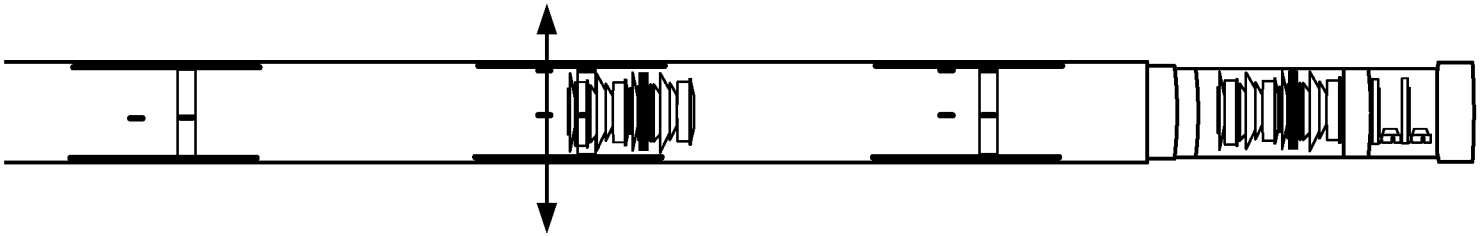
FIG. 15 is the view of FIG. 14 showing a third zone between the first and second treated zone being treated next.

FIGS. 13-15 show three treatment valves 22, 22' and 22". Because of the unique profile at each of these treatment valves the order of operation can be 22, 22" then 22' as shown in FIGS. 13-15. The FIGS. 13-15 are schematic to show one possible order depending on the profile of darts 28, 28' and 28". The second dart 36 that would land on each dart 28 at the various valves 22 is omitted from these FIGS. for greater clarity in illustrating that any order of sleeve 22 operation is possible when each of the sleeves have a unique latch profile including bottom up, top down or random. As mentioned before, after all the treatment is over the sleeves 22 corresponding to the zones to be operated can be opened with or without borehole intervention as explained above. At any time during production wiper 46 can be pumped down. It has a generic pattern that can latch on each sliding sleeve 34 and move such a sleeve to a closed position such as by positioning blank portion 82 opposite openings 54 to close them. As mentioned before an index mechanism allows movement from closed to open and again to closed during the treatment phase. Thereafter for production the sliding sleeves 34 in each treatment valve 22 can be further indexed to wide open, screened, or choked either with or without wellbore intervention using the detent feature shown schematically as 68.

Those skilled in the art will appreciate that the present invention enables treatment such as fracturing, acidizing, injection, for example in any needed order using objects with unique profiles that register in a specific location of a treatment valve that has the mating profile. The initial opening, treatment and closing sequence for a specific sliding sleeve valve can be done without intervention using pressurized darts. A starter valve at the toe of the well provides for displaced fluid ahead of the darts into the formation and acts as a repository for the darts blown through the sleeve with pressure as the sleeve closes. Thereafter, when the treatment is concluded sliding sleeve valves can be opened in a variety of modes for functions such as flow balancing with the choke open feature, for example. Valves can also be placed in screened open position or left closed or again put in a fully open position such as used during treatment. Such a reopening of one or more sliding sleeves can take place with or without well intervention depending on the configuration of the sliding sleeves. The sliding sleeves can be moved with a shifting tool additional wipers combined with pressure cycles and j-slots or dedicated motors that can be actuated locally or remotely. In case of a need to rapidly shut the well in, a dart that registers with all the sleeves can be delivered to engage each of the sleeves and close such sleeves before being blown through to land on the next sleeve in order. The sleeves that are still open at this time will move closed before such a dart moves through. The sleeves already closed will be configured to not move further but simply will release the dart to a new sleeve or the catcher without moving at all.

A one way valve may be installed in at least one tubular wall port described above. Further, a swelling sleeve may be used in at least one port of the valves to close to close off flow if water is produced. The valve may be utilized with any tubulars in subterranean treating system such as casing, liners and the like. In the case of liners, the valve is provided in the liner and the liner is supported in open hole or in a cemented annulus by mounting a liner top hanger packer with opposed slip wedges that slide on each other against a surrounding tubular for support of the liner.

The above description is illustrative of the preferred embodiment and many modifications may be made by those skilled in the art without departing from the invention whose scope is to be determined from the literal and equivalent scope of the claims below.

What is claimed is:

1. A multizone formation treating method, comprising:

locating valves having a unique latching profiles at spaced locations in a tubular extending to the zones in the formation;

delivering a first object having a matching profile to at least one said latch profile for sealingly landing on the valve associated therewith;

moving said valve with said landed first object with pressure to open at least one tubular wall port to the formation at said valve;

treating the formation through said at least one opened port;

applying pressure into the tubular to exert pressure on the first object to close said at least one port associated with the valve that has the landed first object;

removing said landed first object from the landed position on said valve to open a passage through that valve; and repeating the above with at least one additional object having a different latch profile designed to land in another predetermined said valve.

2. The method of claim 1 further including the step of reopening with or without borehole intervention said at least one tubular wall port adjacent at least one said valve after said treating to begin production.

3. The method of claim 2 further including the step of positioning said at least one reopened wall port in full open, choke or screened configuration.

4. The method of claim 3 further including the step of balancing flow from the formation with multiple reopened ports at multiple said valves using at least one of said full open, choke or screened configurations.

5. The method of claim 2 further including the steps of using wireline or coiled tubing or a tractor device on slickline for said intervention for said reopening.

6. The method of claim 2 further including the step of closing all open wall ports after production without intervention with a closure object that engages each said valve while passing through a passage thereof.

7. The method of claim 1 further including the step of treating the formation in a bottom up, top down or in a random order.

8. The method of claim 1 further including the steps of:

moving said at least one valve initially to open an associated at least one port;

providing a detent to stop movement of said at least one valve after said initial movement to open said at least one associated port;

overcoming said detent to further move said at least one valve to close said associated at least one port; and breaking a breakable member to release at least a portion of said first object from said passage in said valve.

9. A multizone formation treating method, comprising:

locating valves having a unique latching profiles at spaced locations in a tubular extending to the zones in the formation;

delivering a first object having a matching profile to at least one said latch profile for sealingly landing on the valve associated therewith;

moving said valve with said landed first object with pressure to open at least one tubular wall port to the formation at said valve;

treating the formation through said at least one opened port;

landing a second object on said first object to isolate said at least one port between said objects;

applying pressure into the tubular;

closing said at least one port associated with the valve that has the landed first object, removing said landed first object from the landed position on said valve and the second object to open a passage through that valve; and repeating the above with a third object having a different latch profile designed to land in another predetermined said valve and a fourth object for landing on the third object.

10. The method of claim 9 wherein the step of applying pressure into the tubular includes the step of applying pressure to said second object to move said first and second objects in tandem out of said passage on said valve to reopen said passage.

11. The method of claim 9 further including the step of applying pressure to said second object to move said valve and to physically close said at least one port.

12. The method of claim 11 further including the step of pushing said first and second objects out of said passage to a remote location in the borehole.

13. The method of claim 12 further including the steps of:

providing a lowermost starter valve; and opening said starter valve before said delivering said first object to allow fluid displacement ahead of said first object.

14. The method of claim 13 further including the steps of:

pushing said first object past said starter valve upon removal from said passage to get a surface signal that said first object has been removed from said passage, and collecting said first object and subsequent objects in a chamber in said starter valve.

15. The method of claim 14 further including the step of closing said starter valve after completion of treatment and before producing the formation using a last object pushed out of a said passage in a said valve.

16. The method of claim 15 further including the step of setting a packer with said last object after closing said starter valve.

17. The method of claim 9 further including the steps of:

using first and second darts as said first and second objects;

providing a lowermost starter valve; and opening said starter valve before said delivering said first dart to allow fluid displacement ahead of said first dart.

18. A method for treating a formation that has at least a first and a second zone, comprising the steps of:

providing a tubular extending to the first and second zones in the formation, wherein the first zone is above the second zone;

first closing the flow passage through the tubular;

opening a first port providing fluid communication between the interior of the tubular and the first zone;

first treating the first zone;

closing the first port;

first opening the flow passage through the tubular;

second closing the flow passage through the tubular;

opening a second port providing fluid communication between the interior of the tubular and the second zone;

second treating the second zone;

closing the second port; and second opening the flow passage through the tubular.

* * * * *